US008359736B2

(12) United States Patent
Lu

(10) Patent No.: US 8,359,736 B2
(45) Date of Patent: Jan. 29, 2013

(54) CRIMPING TOOL

(76) Inventor: Yueh-Chiung Lu, Ta-Yuan Township, Tao-Yuan County (TW)

( * ) Notice: Subject to any disclaimer, the term of this patent is extended or adjusted under 35 U.S.C. 154(b) by 0 days.

(21) Appl. No.: 13/429,163

(22) Filed: Mar. 23, 2012

(65) Prior Publication Data

US 2012/0192410 A1 Aug. 2, 2012

Related U.S. Application Data

(63) Continuation-in-part of application No. 13/074,701, filed on Mar. 29, 2011, now abandoned.

(30) Foreign Application Priority Data

Aug. 10, 2010 (TW) ..... 99215302 U

(51) Int. Cl.
*H01R 43/042* (2006.01)

(52) U.S. Cl. ..... 29/751

(58) Field of Classification Search ..... 29/750, 29/751

See application file for complete search history.

(56) References Cited

U.S. PATENT DOCUMENTS 5,042,286 A * 8/1991 Wiebe et al. ..... 72/414
6,293,004 B1 * 9/2001 Holliday ..... 29/751
7,096,573 B2 * 8/2006 Holliday ..... 29/751

* cited by examiner

*Primary Examiner* — Livius R Cazan
(74) *Attorney, Agent, or Firm* — Muncy, Geissler, Olds & Lowe, PLLC

(57) ABSTRACT

A crimping tool for crimping a coaxial cable with a cable-end connector, comprises a tool body, a lever and a linking mechanism. The lever and the linking mechanism are connected pivotally and separately with the tool body. The linking mechanism includes a locating block for mounting to a working device which has a connection member, a working head, a shank connecting the connection member and the working head, a sliding socket capping onto the working head and a spring member mounted around the shank. When the inner diameter of a collar of the cable-end connector is larger than the outer diameter of the sliding socket, the sliding socket and working head mount into the collar. When the inner diameter is smaller than the outer diameter of the sliding socket but larger than the outer diameter of the working head, the collar pushes the sliding socket to slide towards the shank.

6 Claims, 13 Drawing Sheets

CRIMPING TOOL

CROSS REFERENCE TO RELATED ART

This application is a Continuation-In-Part of U.S. application Ser. No. 13/074,701, filed on Mar. 29, 2011, which is now abandoned. The patent application identified above is incorporated here by reference in its entirety to provide continuity of disclosure.

BACKGROUND OF THE INVENTION

1. Field of the Invention

The present invention relates to a hand tool for crimping a coaxial cable with a cable-end connector and more particularly, to a crimping tool, which is practical for crimping a coaxial cable with a cable-end connector of any of a variety of different sizes accurately and rapidly with less effort.

2. Description of the Related Art

When connecting a cable-end connector to a coaxial cable, a scissor type or stapler type crimping tool must be used to crimp the coaxial cable with the cable-end connector so that the cable-end connector can be firmly secured to the coaxial cable. FIG. 11 illustrates a conventional scissor type crimping tool. According to this design, the scissor type crimping tool comprises a connection block A having a cable hole A1, a first plier member B pivoted to a first side A2 of the connection block A, a first spring B1 mounted on the top end of the first plier member B, a second plier member C pivoted to a second side A3 of the connection block A, a second spring C1 mounted on the top end of the second plier member C, a slide D disposed at the bottom side of the cable hole A1 and having a top press portion D1, a first link E having a first end E2 pivotally connected to the first plier member B and a second end E1 pivotally coupled to a first side D2 of a link E, and a second link F having a first end F2 pivotally connected to the second plier member C and a second end F1 pivotally connected to a second side D3 of the slide D. When the first plier member B and the second plier member C are moved toward each other, the first link E and the second link F are forced to move the slide D linearly relative to the connection block A, thereby crimping a cable H with a cable-end connector G that is set between the slide D and the connection block A.

Because the size of the cable-end connector G varies from different models and different suppliers, the fixed configuration of the top press portion D1 of the slide D cannot fit all different sizes of the cable-end connector G. To solve this problem, different sizes of detachable top press portions D1 may be selectively used with the slide D so that one single crimping tool can be used for crimping different sizes of cable-end connector G. However, it is complicated to change the detachable top press portion D1, wasting much labor and time.

FIG. 12 illustrates a conventional stapler type crimping tool. According to this design, the stapler type crimping tool comprises a plunger I having a tip extender I1, a cylindrical body I11 of the tip extender I1 connected through a nose I111 to a bore I12 in the cylindrical body I11, the nose I111 having a slot I112 facing upwards, a base I2 mounted at the bottom side of the plunger I and having a recess I21 inserted by a substitute extender I1' to screw into a screw I22 inside. As the substitute extender has a nose I111 longer than that of the tip extender I1, the tip extender I1 and substitute extender I1' can be mounted on the plunger I when cable-end connectors G of different lengths are assembled, making it unnecessary for users to bring crimping tools of different specifications with them. In practical use, however, since it takes some time to mount and dismount the tip extender I1 and the substitute extender I1', the crimping tool is still not convenient to use. Moreover, if several cable-end connectors of different size need to be assembled, the tip extender I1 and the substitute extender I1' have to be assembled and disassembled frequently, and this requires the user to expend a lot of time.

Thus, some manufacturers carry out research and development efforts on this issue and launch a stapler type crimping tool, as shown in FIG. 13. According to this design, the stapler type crimping tool comprises a plunger body J having an enlarged end J1 and covered by a sleeve J2, a cup-shaped housing J3 established around the plunger body J to push against the enlarged end J1 and connect with a shoulder J11 of the plunger body J, and an annular end wall J31 of the cup-shaped housing J3 pushed against the shoulder J11 elastically by a spring J4 set between the sleeve J2 and it, so as to make the cable-end connector G push the cup-shaped housing J3 towards the sleeve J2 and press the spring J4 to produce resilient deformation, thus forcing the enlarged end J1 fully into the cable-end connector G to make the cable-end connector G and the coaxial cable H be coupled firmly. However, as there are cable-end connectors of both different lengths and different inner or outer diameters, if the inner diameter of the cable-end connector G is larger than the outer diameter of the enlarged end J1, the cable-end connector G will deflect from the center and cannot align with the enlarged end J1. As a result, the enlarged end J1 deflects from the front side of the cable-end connector G, making it impossible to connect them, or the cable-end connector G tilts after being connected with the coaxial cable H firmly, making it difficult to use.

SUMMARY OF THE INVENTION

The present invention has been accomplished under the circumstances in view. It is one object of the present invention to provide a crimping tool, which is practical for crimping a coaxial cable with a cable-end connector of any of a variety of different sizes accurately and rapidly with less effort.

To achieve this and other objects of the present invention, a crimping tool comprises a tool body, a lever pivoted to the tool body, and a linking mechanism having a link axially slidably coupled to the tool body inside the receiving chamber and movable by the lever, a locating block located on one end of the link opposite to the lever and a working device consisting of a shank, a connection member, an expanded working head, a sliding socket and a spring member. The working device is connected to the locating block for crimping a coaxial cable with a cable-end connector of any of a variety of different sizes accurately and rapidly with less effort. If the inner diameter of the collar of the cable-end connector is smaller than the outer diameter of the sliding socket but greater than the working head of the working device, the collar attached to the working head will push the sliding socket to slide only on the outer surface of the working head. If the inner diameter of the collar is greater than the outer diameter of the sliding socket, the sliding socket and the working head can be directly inserted into the inside of the collar, making the working device disposed rightly at the center of the collar. This allows the working device to be suitable for cable-end connectors that comprise collars of different inner diameters, and makes it unnecessary for working personnel to bring crimping tools or working devices of different types with them. Besides, it makes it unnecessary to replace crimping tools or mount/dismount/replace the working device in the working process, thus achieving purposes of quick fabrication, less labor and effort, improved applicability and convenience and lower cost.

Another object of the present invention is to establish an annular guiding bevel converging forwards on the front side of the sleeve of the sliding socket, so that the collar of the coaxial cable pushes against the guiding bevel and aligns with the sliding socket and working head of the working device when the collar inclines, making the collar align automatically in the crimping process and further achieving the purpose of simplifying processing steps and improving crimping efficiency.

DETAILED DESCRIPTION OF THE PREFERRED EMBODIMENT

Figure 1:
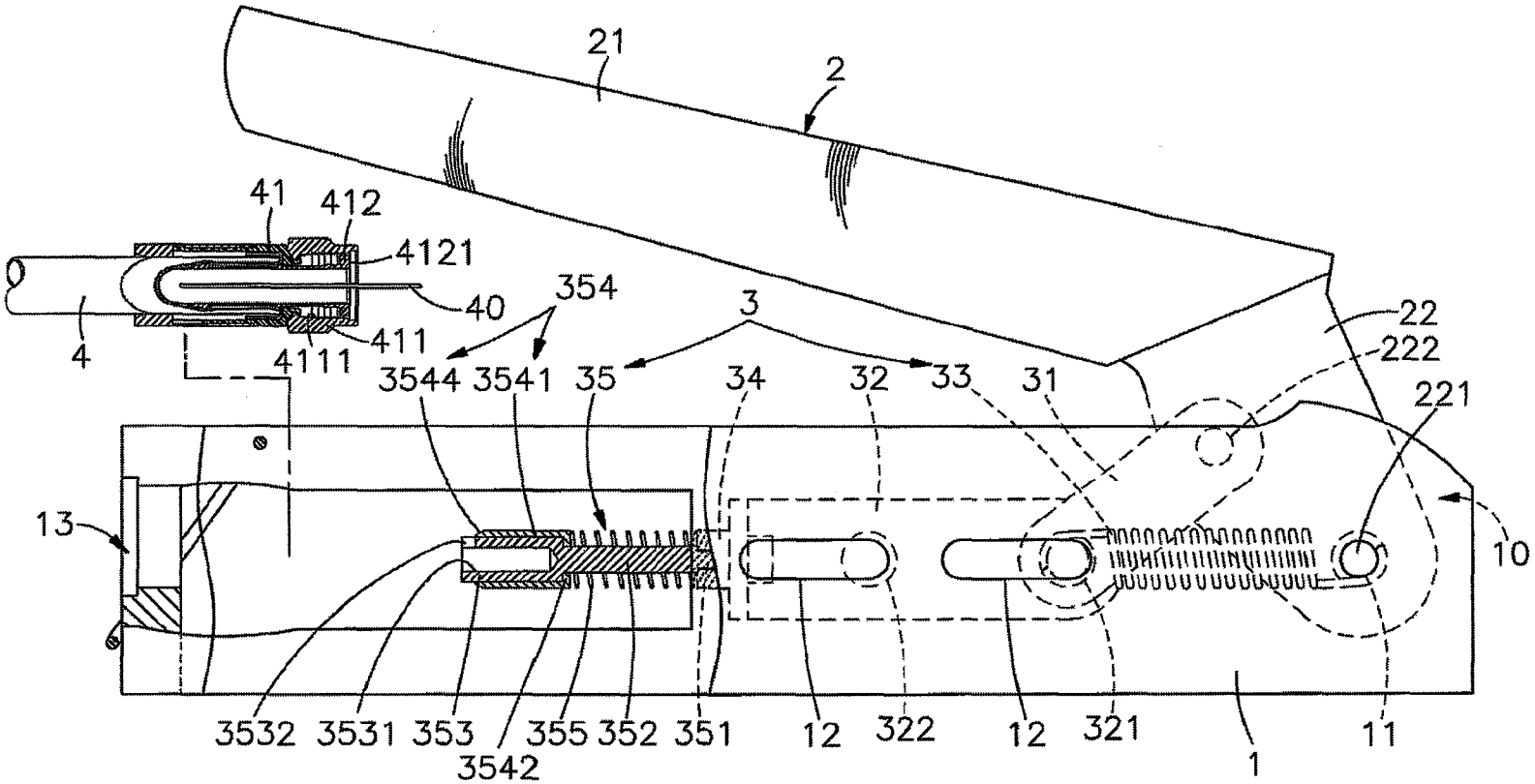
FIG. 1 is a sectional side view of a crimping tool in accordance with the present invention.
Figure 2:
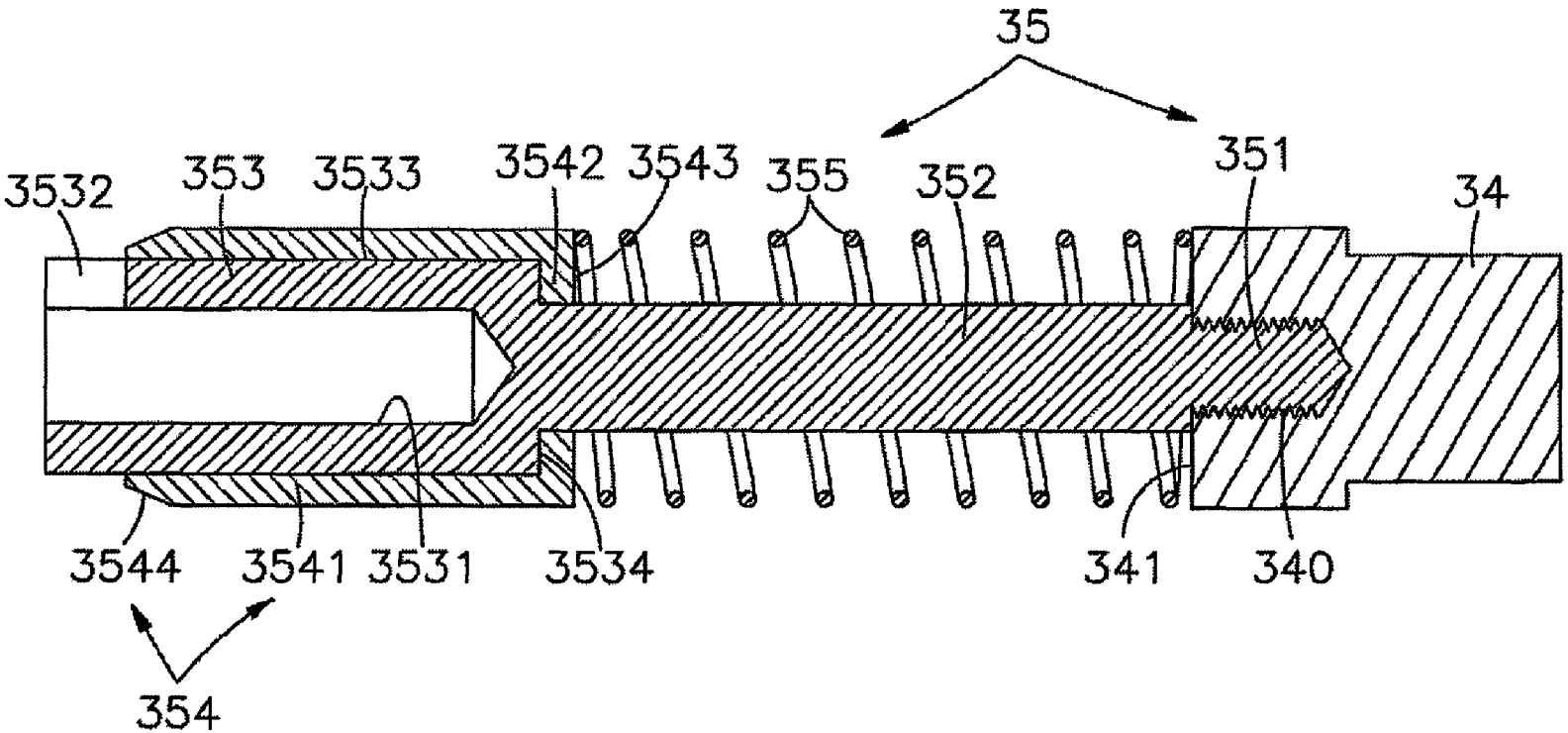
FIG. 2 is a sectional view, in an enlarged scale, of the working device shown in FIG. 1.
Figure 3:
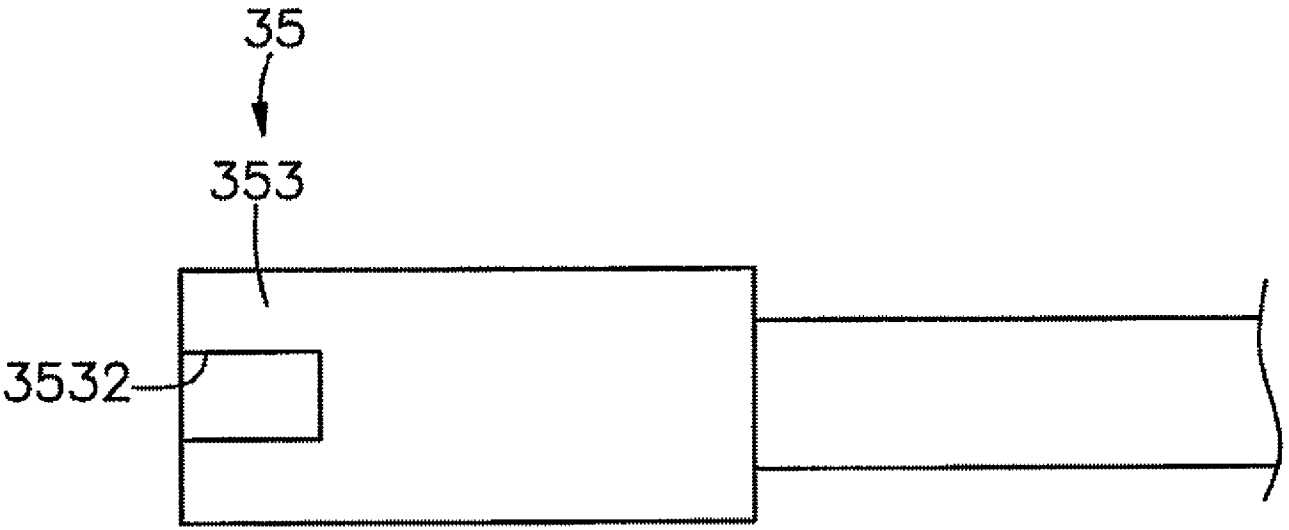
FIG. 3 is a top view of the working device of the crimping tool in accordance with the present invention.
Figure 4:
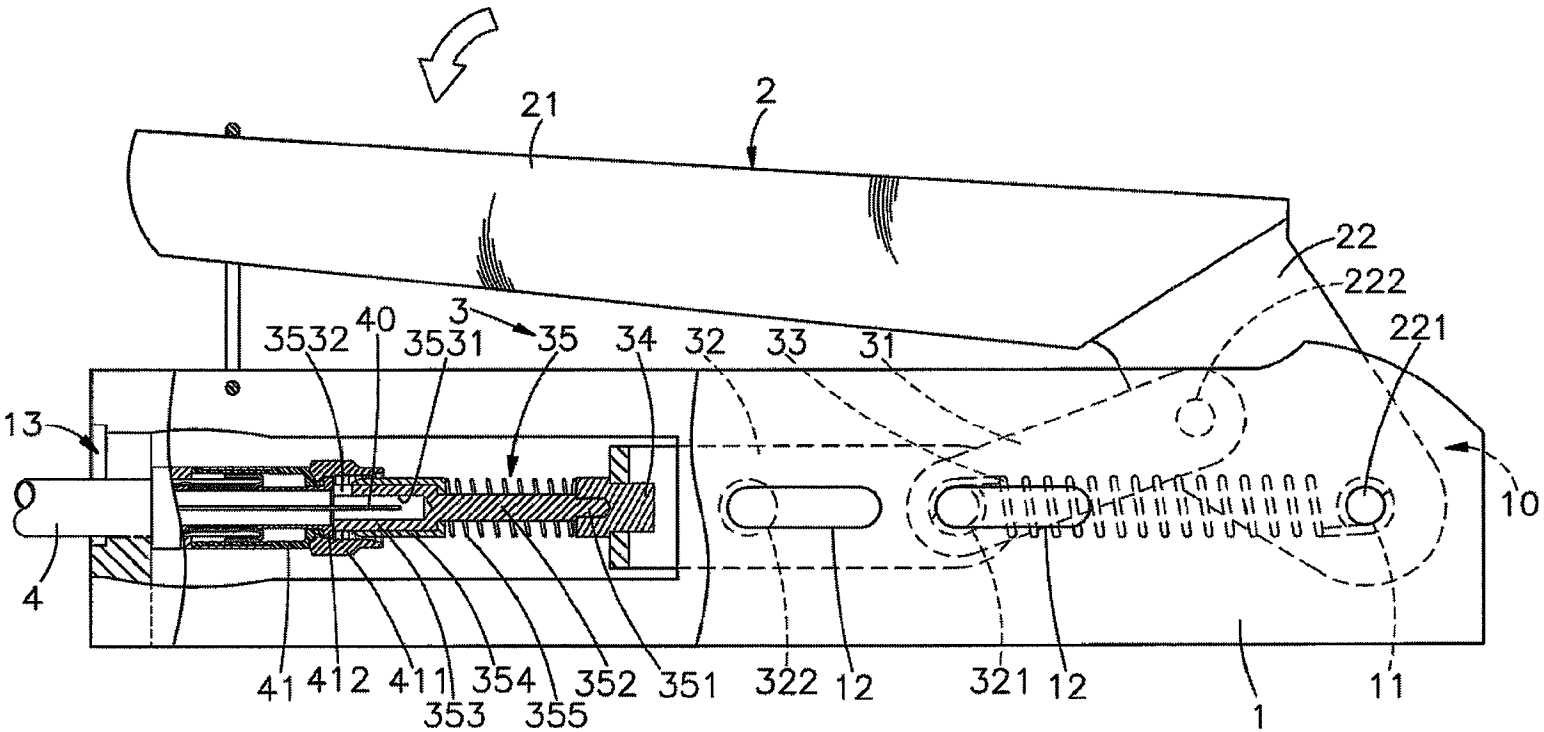
FIG. 4 is a schematic sectional side view of the present invention illustrating a coaxial cable with a cable-end connector set in the tool body of the crimping tool and crimped.
Figure 5:
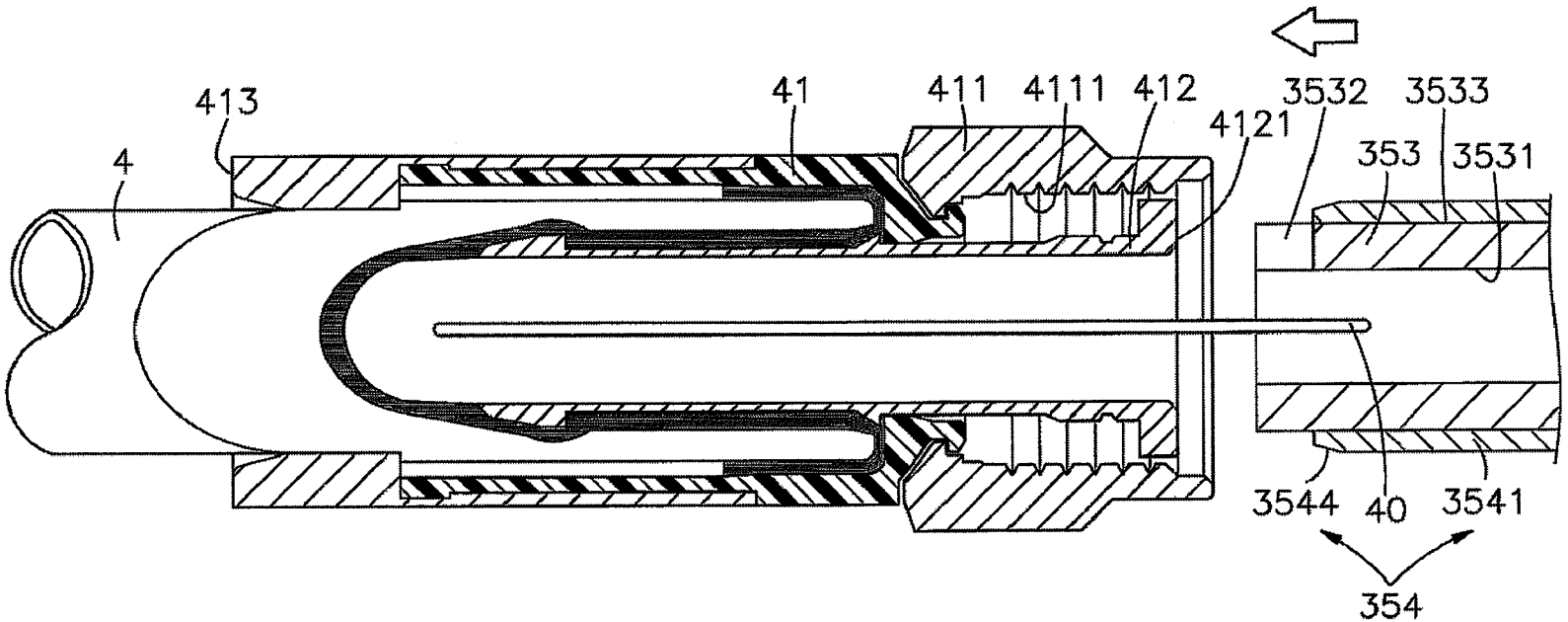
FIG. 5 is a schematic sectional applied view of the present invention, illustrating a coaxial cable attached with a cable-end connector set before crimping.
Figure 6:
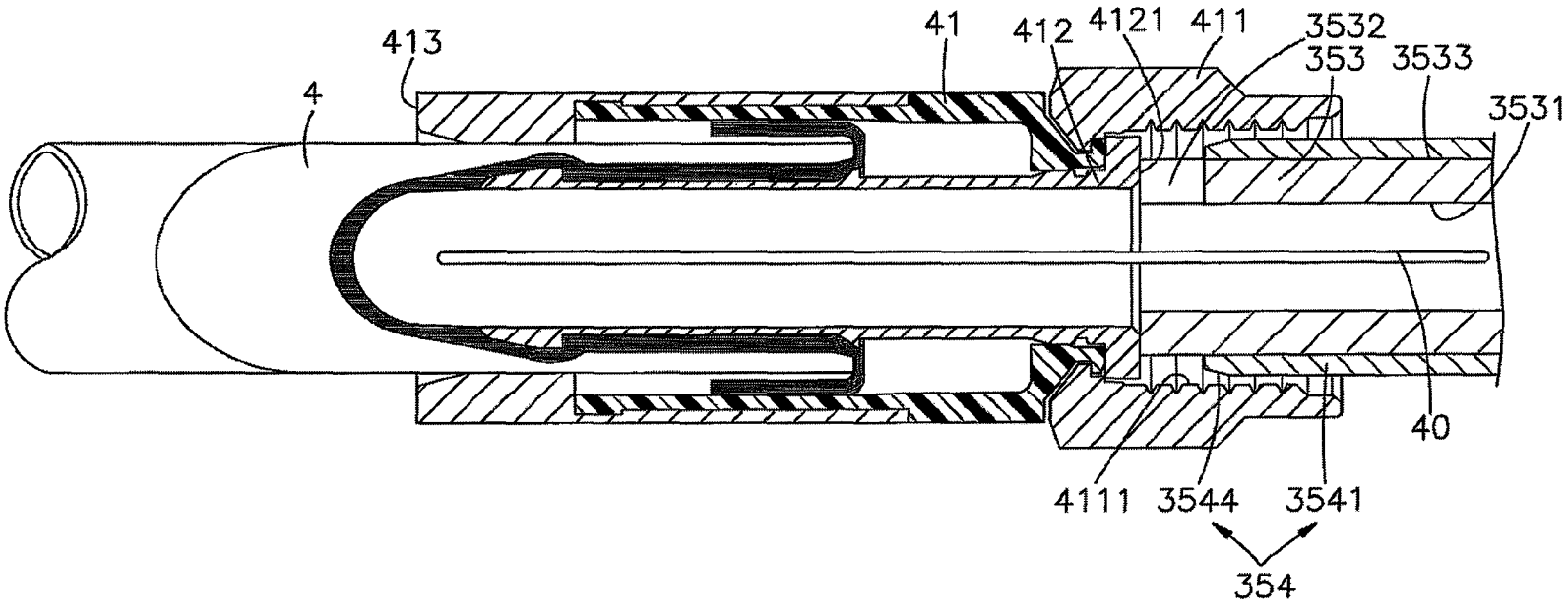
FIG. 6 corresponds to FIG. 5, illustrating the working head with the sliding socket entered the collar of the cable-end connector.
Figure 7:
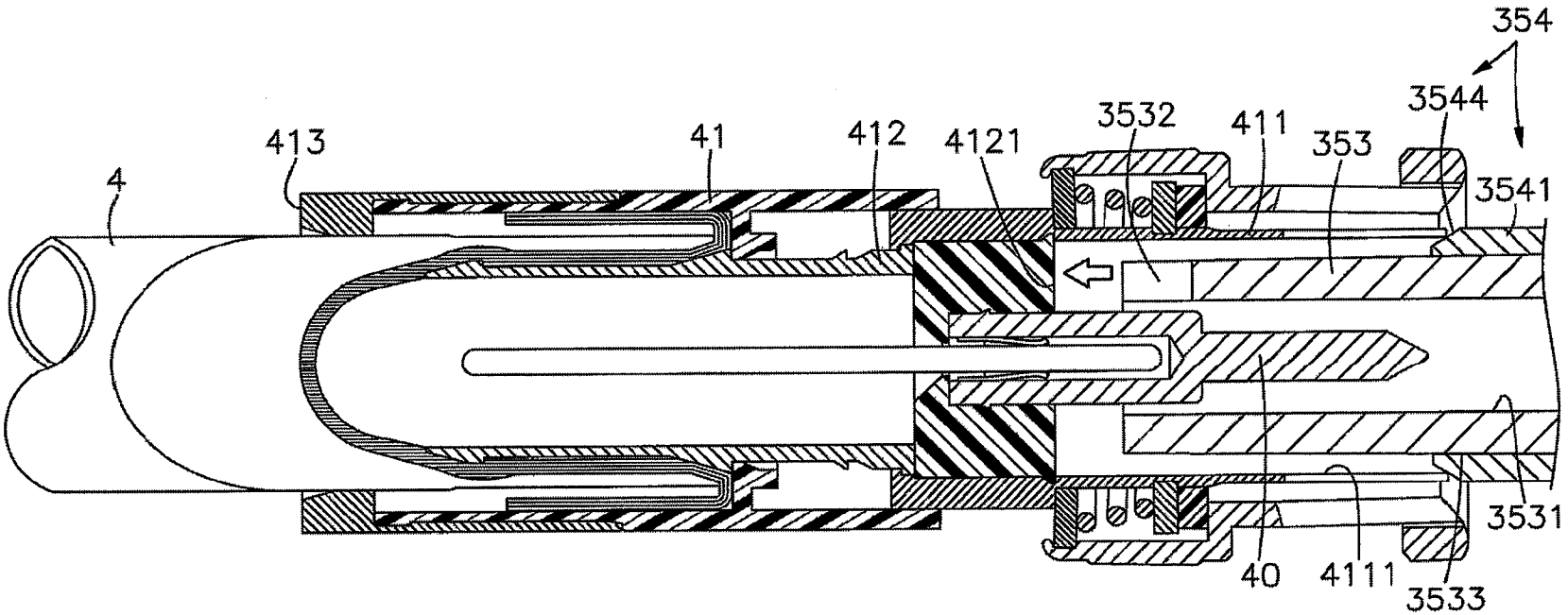
FIG. 7 is another schematic sectional applied view of the present invention, illustrating a coaxial cable with a cable-end connector attached to the working device of the crimping tool and the sliding socket stopped outside the collar of the cable-end connector.
Figure 8:
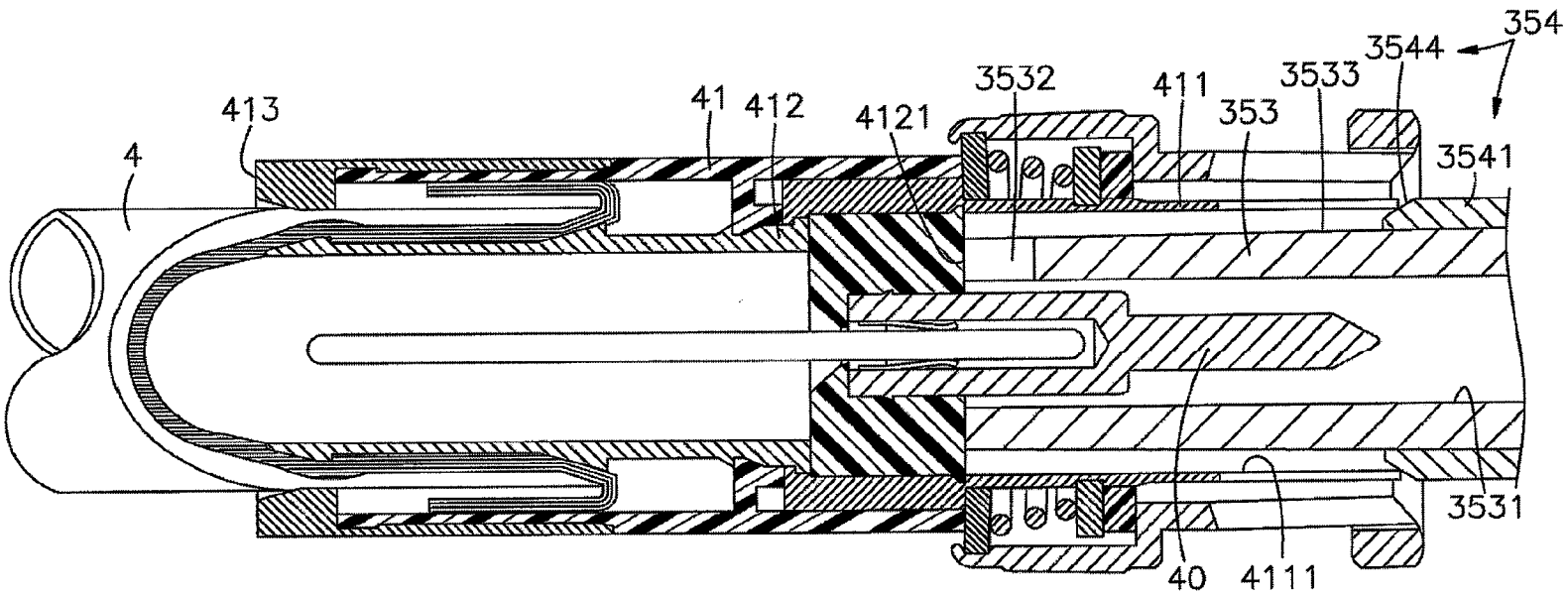
FIG. 8 corresponds to FIG. 7, illustrating the coaxial cable and the cable-end connector crimped.
Figure 9:
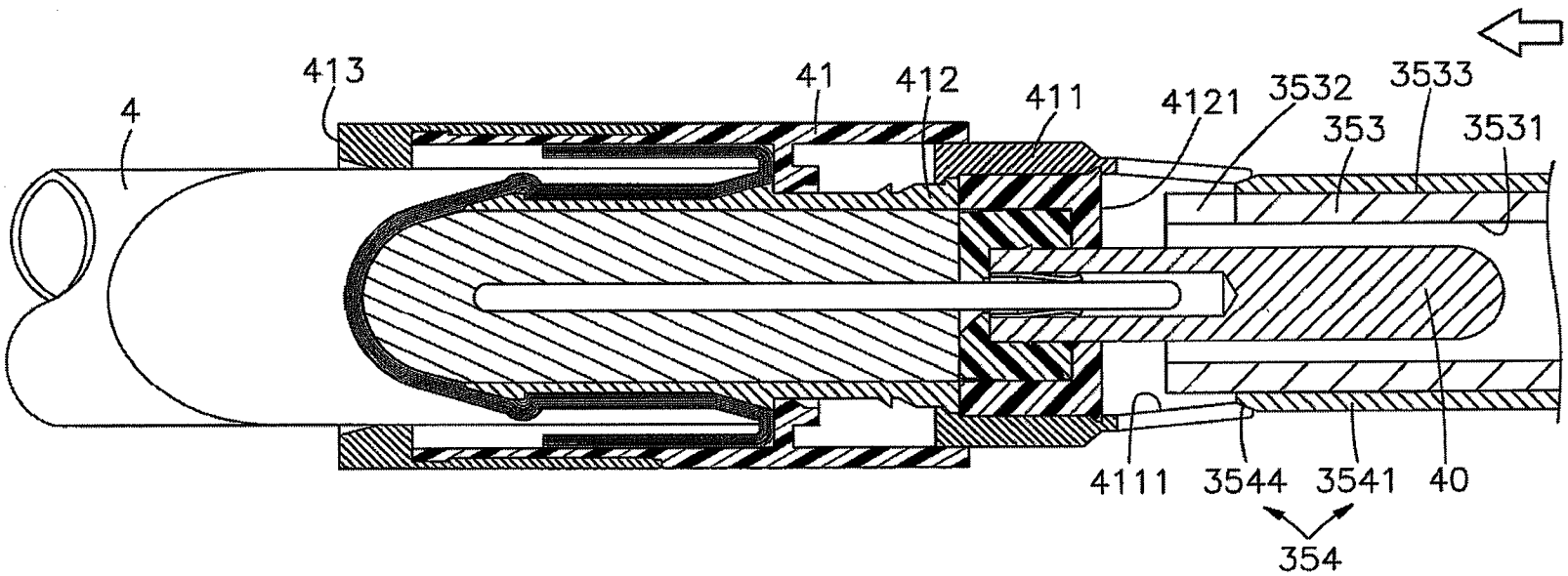
FIG. 9 is still another schematic sectional applied view of the present invention, illustrating a coaxial cable with a cable-end connector attached to the working device of the crimping tool and the center conductor of the cable-end connector inserted through the receiving hole of the working head before crimping.
Figure 10:
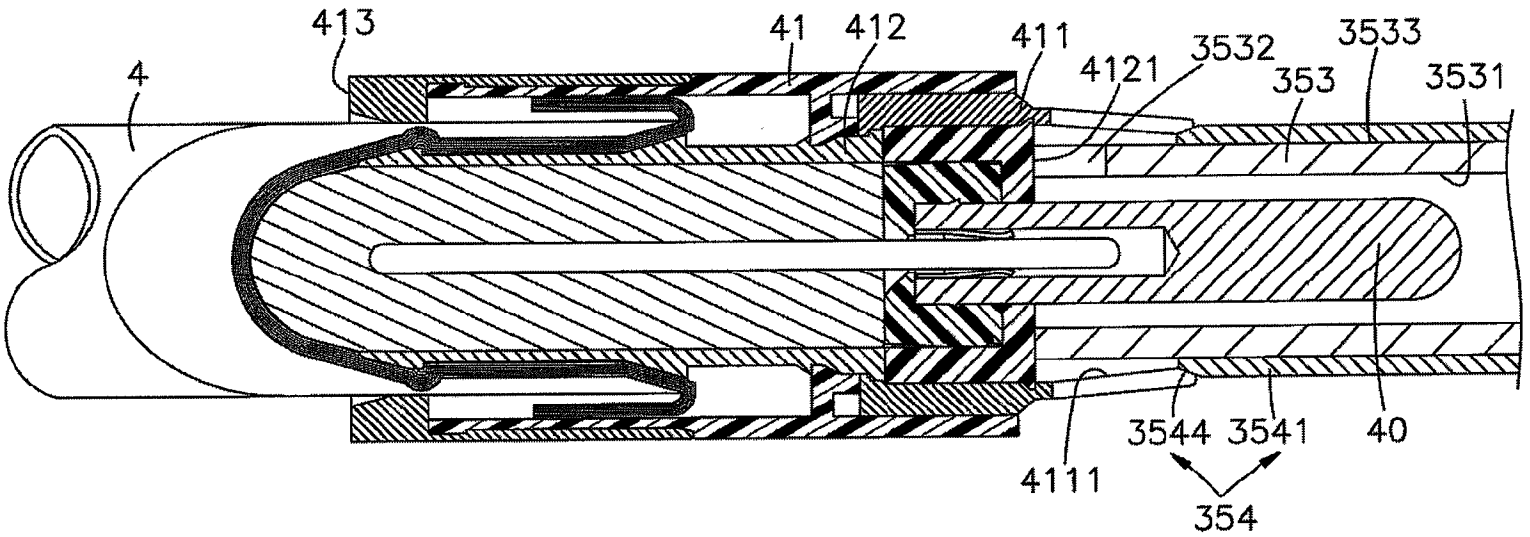
FIG. 10 corresponds to FIG. 9, illustrating the coaxial cable and the cable-end connector crimped.
Figure 11:
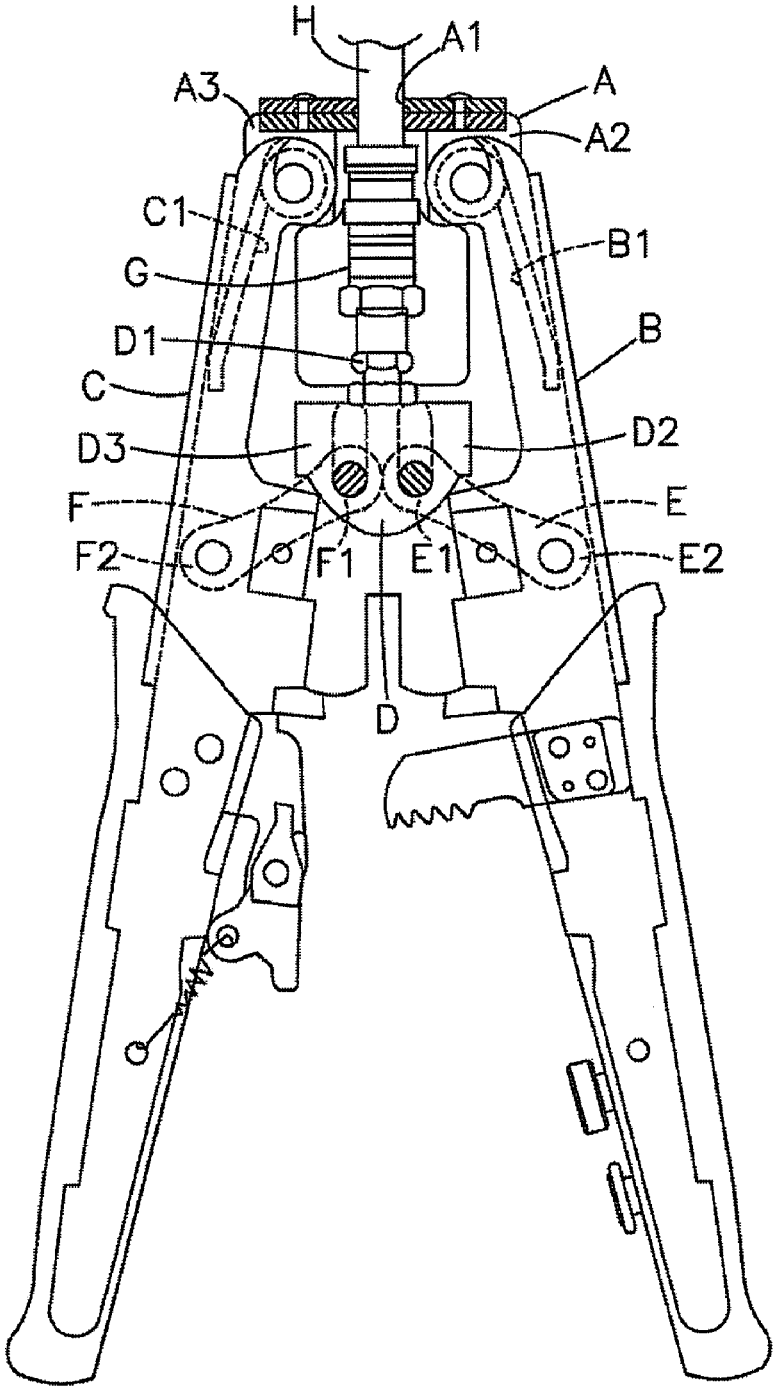
PRIOR ART FIG. 11
FIG. 11 is a schematic plain view of a scissor type crimping tool according to the prior art.
Figure 12:
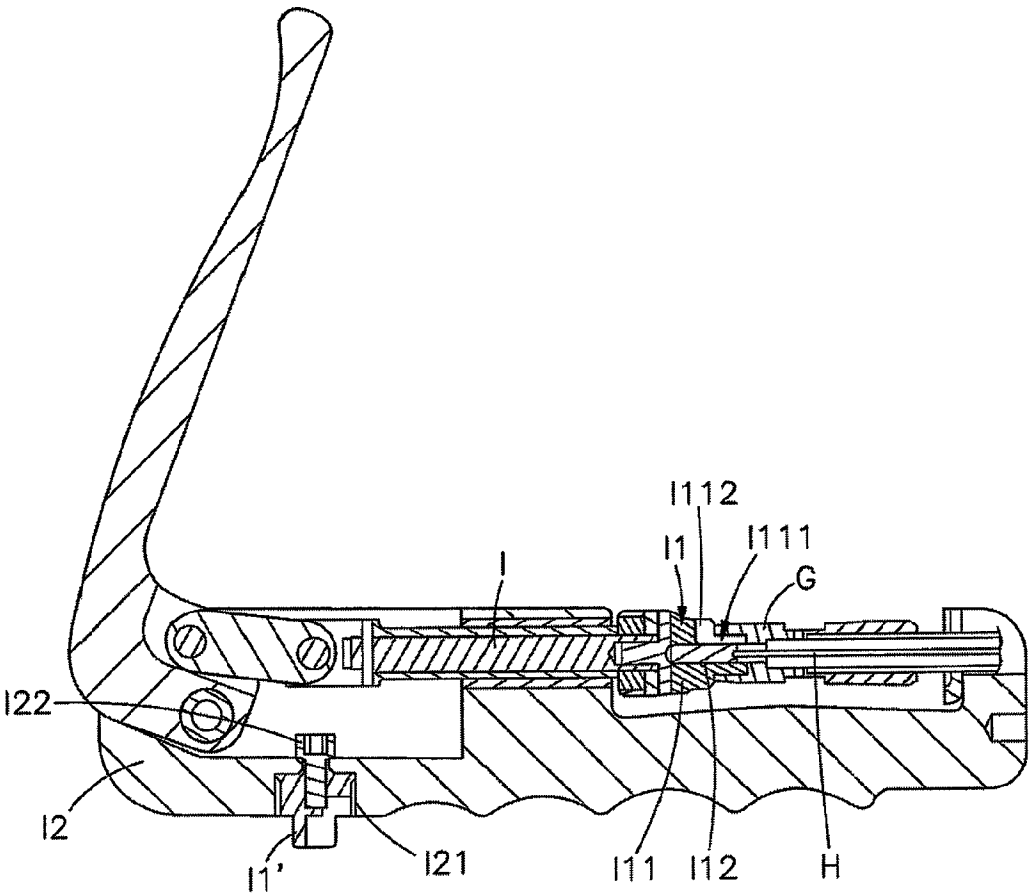
PRIOR ART FIG. 12
FIG. 12 is a schematic sectional view of a stapler type crimping tool according to the prior art.
Figure 13:
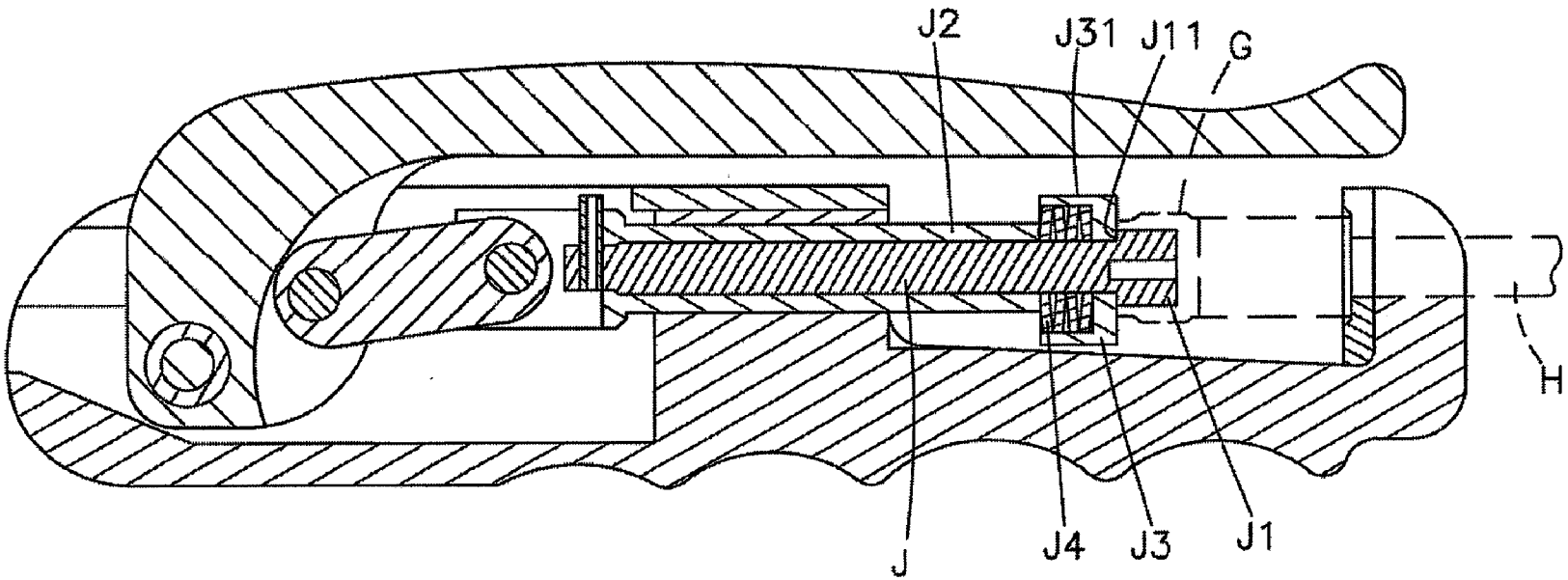
PRIOR ART FIG. 13
FIG. 13 is a schematic plain view of another stapler type crimping tool according to the prior art.

Referring to FIGS. 1, 2 and 3, a crimping tool in accordance with the present invention is shown comprising a tool body 1, a lever 2, and a linking mechanism 3.

The tool body 1 comprises a receiving chamber 10, a pivot hole 11 cut through each of the two opposite lateral sides thereof and disposed in communication with the receiving chamber 10 near its one end, first and second longitudinal sliding slots 12 cut through each of the two opposite lateral sides thereof and horizontally aligned in line and disposed in communication with the receiving chamber 10, and a positioning block 13 mounted in one end of the receiving chamber 10 remote from the first and second longitudinal sliding slots 12 and the pivot hole 11.

The lever 2 comprises a front connection portion 22, a rear operating portion 21 backwardly extended from a rear end of the front connection portion 22 at an obtuse angle, a first pivot 221 located on a front end of the front connection portion 22 remote from the rear operating portion 21 and pivotally connected between the two pivot holes 11 of the tool body 1, and a second pivot 222 located on the front connection portion 22 near its one side and spaced between the rear operating portion 21 and the first pivot 221.

The linking mechanism 3 is mounted in the receiving chamber 10 of the tool body 1, comprising two swivel pushrods 31, a link 32, spring members 33, a locating block 34 and a working device 35. The swivel pushrods 31 each have one end respectively pivotally connected with the two distal ends of the second pivot 222 of the lever 2 and the opposite end pivotally connected to one end of the link 32. The link 32 comprises a first transverse coupling rod 321 located on its one end and pivotally coupled to the opposite end of each of the two swivel pushrods 31 and slidably coupled between the two first ones of the first and second longitudinal sliding slots 12 of the tool body 1, and a second transverse coupling rod 322 slidably coupled between the two second ones of the first and second longitudinal sliding slots 12 of the tool body 1. The spring members 33 are connected between the first pivot 221 of the lever 2 and the first transverse coupling rod 321 of the link 32. The locating block 34 is located on the opposite end of the link 32 remote from the first transverse coupling rod 321 and the second transverse coupling rod 322, and has a locating slot 340 at the center of its front surface 341. The working device 35 comprises a shank 352, a connection member 351 axially extended from one end of the shank 352 and fastened to the locating slot 340 of the locating block 34, an expanded and rod-shaped working head 353 located on the opposite end of the shank 352 remote from the connection member 351, the length of the rod-shaped working head 353 being greater than that of a collar 411 of the cable-end connector 41 on the coaxial cable 4, a sliding socket 354 axially slidably coupled to the shank 352 and adapted for capping onto the working head 353, and a spring member 355 mounted around the shank 352 and stopped between the front surface 341 of the locating block 34 and a rear wall surface 3543 of the sliding socket 354 to force the sliding socket 354 onto the working head 353. The working head 353 has a receiving hole 3531 axially extending to the front end thereof and facing the positioning block 13 for receiving a center conductor 40 of the cable-end connector 41 to be crimped, and a notch 3532 cut through the periphery and facing the rear operating portion 21 of the lever 2 for the passing of the center conductor 40 if the cable-end connector 41 is too thick or too long. A rear surface 3534 bends continuously from the rear end of an outer surface 3533 of the rod-shaped working head 353 to connect with the shank 352, and the sliding socket 354 consists of a sleeve 3541 pressing around the outer surface 3533 of the working head 353. A sleeve portion 3542 located at the rear side of the sleeve 3541 extends the rear surface 3534 of the working head 353 to the shank 352, and the rear wall surface 3543 perpendicular to the surface of the shank 352 extends backwards from the sleeve portion 3542, while the front end of the sleeve 3541 converges forwards to form a guiding bevel 3544.

Referring to FIGS. 1, 4, 5 and 6, when pressing down the rear operating portion 21 of the lever 2 toward the tool body 1, the two swivel pushrods 31 of the linking mechanism 3 will be forced by the front connection portion 22 to bias in direction toward the positioning block 13 and to push the first transverse coupling rod 321 and second transverse coupling rod 322 of the link 32 along the first and second longitudinal sliding slots 12 of the tool body 1 toward the positioning block 13, causing the spring members 33 to be stretched. At this time, the locating block 34 and the working device 35 are forced forwards by the link 32 toward the positioning block 13. When the biasing force is released from the rear operating portion 21 of the lever 2, the spring members 33 immediately return the swivel pushrods 31, the link 32, the locating block 34 and the working device 35, causing the lever 2 to be moved back to its former position by the swivel pushrods 31.

During a crimping operation, the coaxial cable 4 to be crimped is positioned in the positioning block 13 of the tool body 1, and the cable-end connector 41 that is attached to the coaxial cable 4 before crimping is inserted into the receiving chamber 10 of the tool body 1, enabling the collar 411 of the cable-end connector 41 to be attached to the working head 353 of the working device 35. When pressing down the rear operating portion 21 of the lever 2 toward the tool body 1 at this time, the working head 353 of the working device 35 will be moved forwards to push a stop flange 4121 of a core tube 412 of the cable-end connector 41 in direction toward a retaining portion 413 of the cable-end connector 41, finishing the crimping operation. As the crimping stroke between the collar 411 and the retaining portion 413 of any of a variety of different cable-end connectors 41 is the same, when the biasing force is released from the lever 2, the spring members 33 immediately return the component parts of the crimping tool to their former positions. Thus, the coaxial cable 4 and the cable-end connector 41 fare well crimped.

Referring to FIGS. 1, 2, 3 and 4, if the center conductor 40 of the cable-end connector 41 is too thick or too long and cannot be directly inserted into the inside of the receiving hole 3531 of the working head 353 during insertion of the cable-end connector 41 with the coaxial cable 4 into the receiving chamber 10 of the tool body 1, the center conductor 40 can be directly inserted through the notch 3532 and then set in the receiving hole 3531 of the working head 353, facilitating positioning of the coaxial cable 4 with the cable-end connector 41 in the tool body 1 of the crimping tool.

Referring to FIGS. 1, 2, 4, 5, 6, 7, 8, 9 and 10, the inner diameter of the collar 411 of the cable-end connector 41 varies from different models or different suppliers. If the inner diameter of the collar 411 is greater than the outer diameter of the sliding socket 354, the working head 353 with the sliding socket 354 can be directly inserted into the inside of the collar 411. If the inner diameter of the collar 411 is smaller than the outer diameter of the sliding socket 354 but greater than the outer diameter of the working head 353 of the working device 35, the collar 411 will push the sliding socket 354 to move toward the locating block 34, since the collar 411 cannot touch the front end of the working device 35. The sleeve 3541 and sleeve portion 3542 of the sliding socket 354 slide towards the locating block 34 on the outer surface 3533 of the working head 353 and the surface of the shank 352 respectively, and the distance between the rear wall surface 3543 of the sleeve portion 3542 and the front surface 341 of the locating block 34 reduces to compress the spring member 355 to produce resilient deformations. As the sliding socket 354 slides to make the working head 353 of smaller outer diameter extend out of the front end remote from the locating block 34, the collar 411 can be attached to the working head 353 smoothly. When the lever 2 is biased at this time, the working head 353 of the working device 35 is continuously moved into the inside of the collar 411, and the sliding socket 354 is continuously moved by the collar 411 toward the locating block 34. When the biasing force is released from the lever 2 or the coaxial cable 4 is removed with the cable-end connector 41 out of the crimping tool, the spring member 355 immediately pushes back the sliding socket 354 toward the positioning block 13 to its former position and back to the front end of the working head 353 again.

Besides, as there is the notch 3532 on the working head 353 for the center conductor 40 of the coaxial cable to pass through, in order to prevent the front side of the sleeve 3541 of the sliding socket 354 from obstructing the notch 3532, the sleeve 3541 extends from the outer surface 3533 that connects the rear surface 3534 to the working head 353, and stops following alignment with the rear wall surface of the notch 3532, so that the notch 3532 can be fully exposed; in addition, due to the annular shape of the guiding bevel 3544 of the sliding socket 354, when the connecting inner edge 4111 of the collar 411 of the coaxial cable 4 gets in touch with the front edge of the sleeve 3541, if the collar 411 inclines to one direction, the other side of the connecting inner edge 4111 opposite to the inclining direction will push against the guiding bevel 3544, and the force from the guiding bevel 3544 will push the connecting inner edge 4111 forward, making the collar 411 to move towards the direction opposite to the inclining one, till the connecting inner edge 4111 fully contact the guiding bevel 3544. Thus, it allows the collar 411 to align with the working device 35 automatically in the crimping process, thereby achieving the purpose of simplifying processing steps and improving crimping efficiency.

When a coaxial cable 4 is attached with a different size of cable-end connector 41, it is not necessary to change the model of the crimping tool or replace the working device 35 with those of different size, i.e., the crimping tool of the invention is practical for crimping any of a variety of cable-end connectors 41 with a coaxial cable 4. When a coaxial cable 4 is attached with a cable-end connector 41 and inserted into the crimping tool for crimping, the working head 353 is accurately positioned in the axial center of the collar 411 of the loaded cable-end connector 41 and positively stopped against the stop flange 4121 of the core tube 412 of the loaded cable-end connector 41, facilitating accurate and rapid crimping with less effort.

In conclusion, the invention provides a crimping tool for crimping a coaxial cable 4 with a cable-end connector 41 of any size. The crimping tool comprises a tool body 1 having a receiving chamber 10 defined therein, two pivot holes 11 aligned at two opposite lateral sides near one end of the receiving chamber 10 and a positioning block 13 disposed in the opposite end of the receiving chamber 10, a lever 2 pivotally coupled to the two pivot holes 11 of the tool body 1, and a linking mechanism 3 comprising a link 32, two swivel pushrods 31 coupled between one end of the lever 2 and one end of the link 32, spring members 33 connected between the first pivot 221 of the level 2 and the first transverse coupling rod 321 of the link 32, a locating block 34 located on the other end of the link 32 remote from the swivel pushrods 31 and a working device 35 connected to the locating block 34. The working device 35 comprises a shank 352, a connection member 351 axially extended from one end of the shank 352 and fastened to the locating block 34, an expanded working head 353 located on the opposite end of the shank 352 remote from the connection member 351, a sliding socket 354 axially slidably coupled to the shank 352 and adapted for capping onto the working head 353, and a spring member 355 mounted around the shank 352 and stopped between the locating block 34 and the sliding socket 354 to force the sliding socket 354 onto the working head 353. If the inner diameter of the collar 411 of the cable-end connector 41 to be crimped is greater than the outer diameter of the sliding socket 354, the working head 353 with the sliding socket 354 can be directly inserted into the inside of the collar 411. If the inner diameter of the collar 411 is smaller than the outer diameter of the sliding socket 354 but greater than the outer diameter of the working head 353 of the working device 35, attaching the collar 411 to the working head 353 will push the sliding socket 354 toward the locating block 34 to compress the spring member 355, and thus, the collar 411 can be attached to the working head 353 smoothly. Thus, the crimping tool of the invention is practical for crimping any of a variety of cable-end connectors 41 with a coaxial cable 4. When a coaxial cable 4 is attached with a cable-end connector 41 and inserted into the crimping tool for crimping, the working head 353 is accurately positioned in the axial center of the collar 411 of the loaded cable-end connector 41 and positively stopped against the stop flange 4121 of the core tube 412 of the loaded cable-end connector 41, facilitating accurate and rapid crimping with less effort.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A crimping tool for crimping a coaxial cable with a cable-end connector, comprising:

a tool body comprising a receiving chamber defined therein, two pivot holes aligned at two opposite lateral sides thereof near one end of said receiving chamber and a positioning block disposed in an opposite end of said receiving chamber;

a lever comprising a front connection portion, a rear operating portion backwardly extended from a rear end of said front connection portion, and a first pivot located on a front end of said front connection portion remote from said rear operating portion and pivotally connected between the two pivot holes of said tool body; and a linking mechanism axially slidably coupled to said tool body inside said receiving chamber and movable by said lever, said linking mechanism comprising a link having one end thereof pivotally connected to said front connection portion of said lever, a locating block located on an opposite end of said link and a working device connected to said locating block, said working device comprising a shank, a connection member axially extended from one end of said shank and fastened to said locating block, a rod-shaped working head located on an opposite end of said shank remote from said connection member for inserting into a collar of the cable-end connector, said working head being longer than said collar and having a rear surface continuously bent from a rear side of an outer surface of the working head to said shank, a sliding socket axially slidably coupled to said shank and adapted for capping onto said working head, said sliding socket having a sleeve that presses around the outer surface of said working head, a sleeve portion bent inwards from a rear side of said sleeve and extending on the rear surface of said working head to said shank, said sleeve portion including a rear wall surface perpendicular to the surface of said shank, a front edge of said sleeve converging forwards to form an annular guiding bevel in order to facilitate pressing and guiding said collar of the cable-end connector, and a spring member mounted around said shank and stopped between a front surface of said locating block and the rear wall surface of said sliding socket to force said sliding socket onto said working head; wherein:

when the inner diameter of said collar is larger than the outer diameter of said sliding socket, said working head of said working device and said sliding socket are mounted into said collar simultaneously; when the inner diameter of said collar is smaller than the outer diameter of said sliding socket but greater than the outer diameter of said working head, said collar pushes against said sliding socket to compress said spring member, and said working head is inserted into said collar.

2. The crimping tool as claimed in claim 1, wherein:

said lever further comprises a second pivot located on said front connection portion near one side of said front connection portion and spaced between said rear operating portion and said first pivot; said link comprises a first transverse coupling rod disposed at one end thereof and a second transverse coupling rod spaced from said first transverse coupling rod at a predetermined distance; and said linking mechanism further comprises two swivel pushrods bilaterally pivotally connected between said second pivot of said lever and said first transverse coupling rod of said link.

3. The crimping tool as claimed in claim 2, wherein said linking mechanism further comprises a plurality of spring members connected between said first transverse coupling rod of said link and said first pivot of said lever.

4. The crimping tool as claimed in claim 1, wherein:

said tool body further comprises a first longitudinal sliding slot and a second longitudinal sliding slot cut through each of two opposite lateral sides thereof and horizontally aligned in line and disposed in communication with the receiving chamber; and said link comprises a first transverse coupling rod disposed at one end thereof and slidably coupled to the first longitudinal sliding slots of said tool body and a second transverse coupling rod spaced from said first transverse coupling rod at a predetermined distance and slidably coupled to the second longitudinal sliding slots of said tool body.

5. The crimping tool as claimed in claim 1, wherein said working head of said working device comprises a receiving hole axially extending to a front end thereof and facing said positioning block, and a notch cut through the periphery thereof and facing the rear operating portion of said lever, said sliding socket sleeve extending from the outer surface of the rear surface of said working head to said notch, to align with said notch, so that said notch can be fully exposed.

6. The crimping tool as claimed in claim 1, wherein said rear operating portion of said lever extends backwardly from the rear end of said front connection portion at an obtuse angle.

* * * * *